US005494107A

United States Patent [19]

Bode

[11] Patent Number: 5,494,107

[45] Date of Patent: Feb. 27, 1996

[54] REVERSE CEMENTING SYSTEM AND METHOD

[76] Inventor: Robert E. Bode, 1729-C Brittmore, #C1, Houston, Tex. 77043

[21] Appl. No.: 162,758

[22] Filed: Dec. 7, 1993

[51] Int. Cl.[6] ..... E21B 33/14; E21B 34/10

[52] U.S. Cl. ..... 166/285; 166/242.8; 166/323

[58] Field of Search ..... 166/285, 242, 166/325–328, 323, 318, 193

[56] References Cited

U.S. PATENT DOCUMENTS

| | | | |
|---|---|---|---|
| 2,647,727 | 8/1953 | Edwards | 166/323 X |
| 2,675,082 | 4/1954 | Hall | 166/285 |
| 2,919,709 | 1/1960 | Schwegman | 166/325 X |
| 3,051,246 | 8/1962 | Clark, Jr. et al. | 166/325 |
| 5,297,634 | 3/1994 | Loughlin | 166/187 X |

FOREIGN PATENT DOCUMENTS

| | | | |
|---|---|---|---|
| 1774986 | 11/1992 | Russian Federation | 166/285 |
| 1113518 | 9/1984 | U.S.S.R. | 166/285 |
| 1218075 | 3/1986 | U.S.S.R. | 166/285 |
| 1659626 | 6/1991 | U.S.S.R. | 166/285 |
| 1716096 | 2/1992 | U.S.S.R. | 166/285 |
| 1758211 | 8/1992 | U.S.S.R. | 166/285 |

*Primary Examiner*—Hoang C. Dang
*Attorney, Agent, or Firm*—Bush, Moseley, Riddle & Jackson

[57] ABSTRACT

A cementing system where cement slurry is pumped down the annulus between the casing string and the well bore wall and then allowed to harden therein. A cement shoo on the lower end of the casing string prevents upward flow of fluids as the casing string is run, and then is opened and locked open in response to inside pressure. A normally open check valve in the casing string several joints above the cement shoo has flow passages that are closed by balls or ball discs which are suspended in a fluid spacer that is run ahead of the lower end of the column of cement slurry as it descends in the annulus.

11 Claims, 2 Drawing Sheets

REVERSE CEMENTING SYSTEM AND METHOD

FIELD OF THE INVENTION

This invention relates generally to a system for cementing casing in a well bore, and particularly to a new and improved cementing system where the slurry is pumped directly into the annulus between the casing and the borehole wall while displacing conditioning fluids ahead of the slurry and into the lower end of the casing.

BACKGROUND OF THE INVENTION

After a well bore has been drilled and lined with casing it is the usual practice to cement the casing in place to prevent migration or channeling of water or other fluids along the outer side thereof. Conventional cementing techniques involve displacing cement slurry down through the bore of the casing and out a shoe on the bottom thereof so that the cement fills the annulus between the casing and the well bore wall. A sufficient volume of slurry is displaced so that the top of the cement in the annulus extends several hundred feet up inside the intermediate string of casing.

A bottom plug with a rupture disc or the like is run ahead of the cement column in the casing and a displacement plug is run at the upper end of the column to separate the cement and the displacement fluids. When the bottom plug reaches the shoe at the bottom end of the casing, pressure is used to rupture the disc so that the slurry can be pumped out into the lower end of the annulus. When the top or displacement plug reaches the shoe, most all of the slurry will have been pumped into the annulus. Once the cement has set up or hardened, perforations are shot at one or more intervals in the casing in order to communicate oil-bearing formations with the bore of the casing so that the well can be placed on production.

Although the foregoing cementing technique has been used for many years, it has a number of shortcomings. The process is time consuming because the cement must be pumped all the way to the bottom of the casing and then back up into the annulus. Expensive chemicals must be used to retard set up of the cement. A large amount of very expensive equipment also is necessary. These factors make cementing a very high cost process which adds considerably to the total completion costs of a well.

An object of the present invention is to provide a new and improved well cementing system that obviates the foregoing shortcomings of prior techniques.

Another object of the present invention is to provide a new and improved well cementing system where the slurry is displaced down the annulus instead of down through the casing, which saves considerable time and expense to complete a cementing job.

Still another object of the present invention is to provide a new and improved cementing system of the type described which employs unique cementing shoe and check valve structure that are particularly adapted for use in the a reverse cementing process of the present invention.

SUMMARY OF THE INVENTION

These and other objects are attained in accordance with the concepts of the present invention through the provision of a cementing system that includes a cementing shoe on the lower end of the casing having a normally closed valve element that can be opened, and locked open, when the casing string is landed. A check valve is positioned in the casing several joints above the cementing shoe and has a plurality of normally open flow ports with downward facing valve seats. In accordance with a new and improved cementing method as disclosed herein, well conditioning fluids are pumped down the casing, through the check valve and the cement shoe, and into the annulus so that the annulus can be cleaned up prior to cementing. Then the blowout preventer is closed at the surface, and cement slurry is pumped through a line into the annulus. The column of cement is preceded by a fluid mud spacer which separates the slurry from the well conditioning fluids, and an injector is used to place a plurality of balls or ball discs at the front of the cement column or at the top of the mud spacer. The spacer and slurry pass downward into the annulus between the casing and the borehole wall and then enter the lower end of the casing via the locked-open valve in the cement shoe. When the balls or discs reach the valve seats in the check valve, they automatically lodge in the valve seats to prevent upward flow therethrough. When this occurs a positive indication is given at the surface in the form of a pump pressure increase and/or cessation of mud flow. The cementing job is then complete, and the pressure can be bled off at the surface. If desired, a test ball can be dropped down the casing and landed on an upwardly facing valve seat on the check valve, so that internal pressure can be applied to the casing string to test for leaks.

Since cement slurry normally is more dense than the drilling mud in the well, a swage nipple can be attached at the surface to the upper end of the casing string. This nipple, whose upper end is threaded to the mud return line, provides a reduced diameter flow area or restriction which keeps the mud returns from flowing upward through the casing at a faster rate than the cement slurry is being pumped down into the annulus. The volume of cement that is mixed and pumped is determined such that when the check valve is closed by the balls or ball discs, a relative short length of cement remains in the annulus above the outer casing string shoe in order to seal off this region against any fluid flow.

Inasmuch as the slurry is pumped directly into the annulus, rather than down through the casing string and back up into the annulus, considerably less time, equipment and chemicals are needed to perform a cementing operation. Thus cementing costs are greatly reduced, with consequent savings in well completion costs.

BRIEF DESCRIPTION OF THE DRAWINGS

The present invention has other objects, features and advantages which will become more clearly apparent in connection with the following detailed description of a preferred embodiment, taken in conjunction with the appended drawings in which.

DETAILED DESCRIPTION OF A PREFERRED EMBODIMENT

Figure 1:
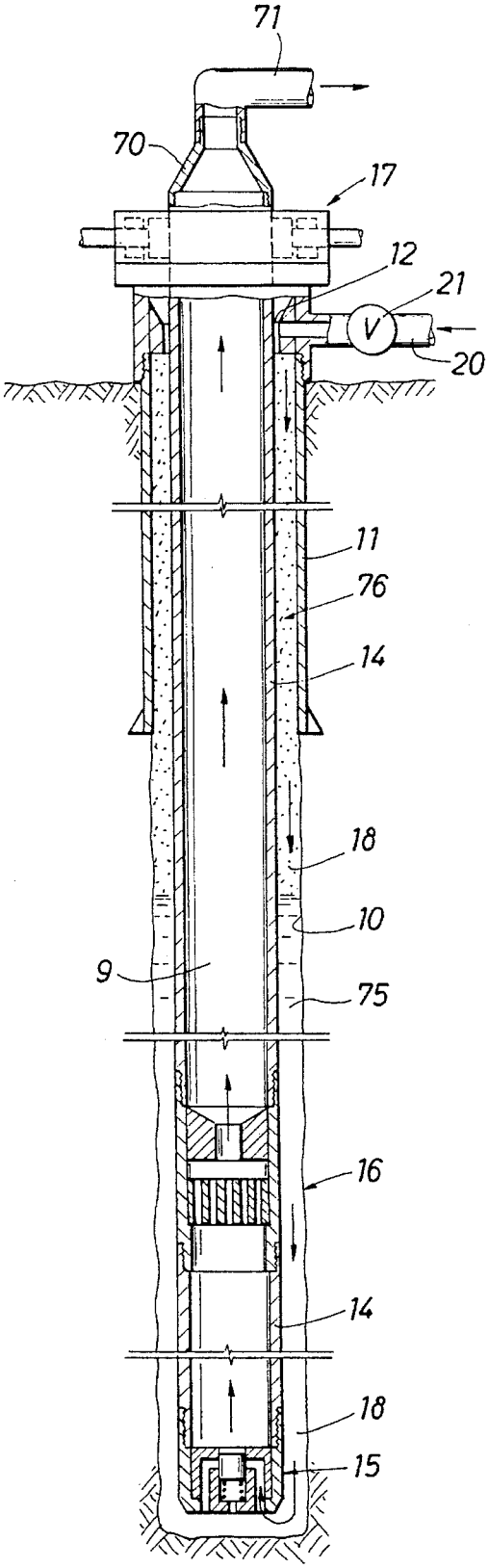
FIG. 1 is a schematic view of a cased well installation prior to the initiation of cementing in accordance with this invention.

Referring initially to FIG. 1, a well bore 10 that has been drilled into the earth has an upper section that is lined with an intermediate string of casing 11. The casing 11 typically depends from a well head 12 and has a shoe 13 at its lower end. A long string of smaller diameter casing 14 extends from the top of the well to the bottom thereof, and has a cement shoe 15 in accordance with the present invention connected to its lower end. A check valve assembly 16, which also is a part of this invention, is connected in the casing 14 several joints above the cement shoe 15, and thus is positioned at a selected distance thereabove. A blowout preventer indicated generally at 17 at the surface has rams that can be closed against the outer periphery of the upper end of the casing 14 in order to seal off the annular space 18 between the casing strings 11 and 14 at the surface. A line 20 having one or more flow control valves 21 has its inner end in communication with the annulus 18 and its outer end connected to typical pumping equipment (not shown).

Figure 2:
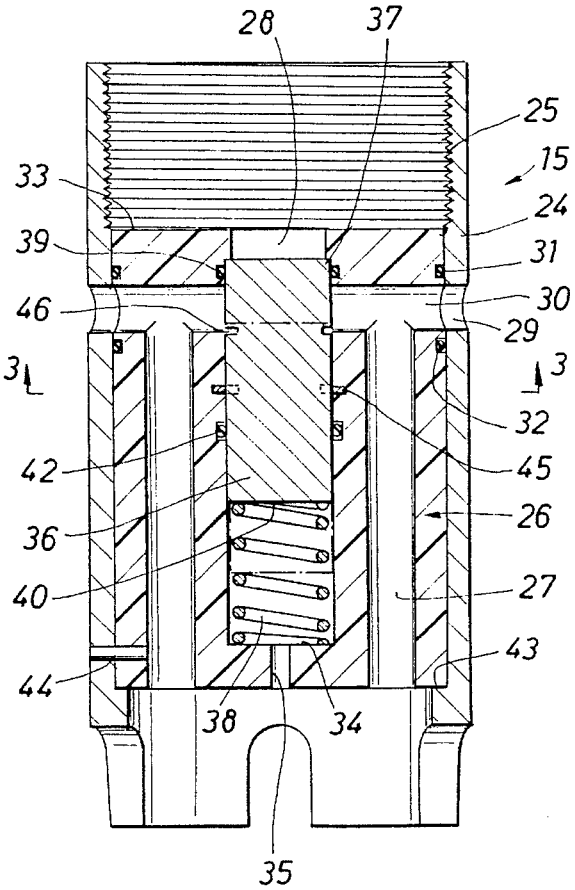
FIG. 2 is a cross-sectional view of the cementing shoe of FIG. 1.
Figure 3:
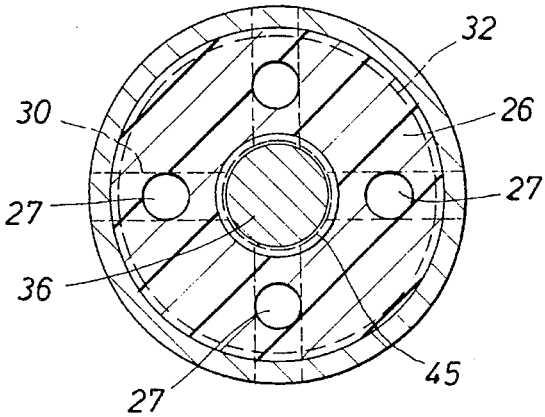
FIG. 3 is a cross-section on line 3—3 of FIG. 2.

As shown in FIG. 2, the cement shoe 15 includes a tubular body 24 having threads 25 by which it is attached to the lower end of the casing string 14. The body 24 receives an insert 26, preferably made of a suitable plastic, having a plurality of vertical flow ports 27 which are communicated with a central bore 28 by lateral ports 30. The outer ends of the ports 30 can register with holes 29 in the walls of the body 24. Seal tings 31, 32 prevent fluid leakage between the insert 26 and the body 24. The bore 28 extends from the top surface 33 of the insert 26 to a lower shoulder 34 having a pressure relief port 35 opening therethrough. A valve element 36 in the form of a metal or plastic plug is slidably mounted in the bore 28, and is biased upward against a seat surface 37 by a compression coil spring 38 which reacts between the lower surface 40 of the element 36 and upper surface of the shoulder 34. A seal ring 42 prevents fluid leakage past the valve element 36. The insert 26 is supported by an internal shoulder 43 near the lower end of the body 24, and one or more pins 44 are used to prevent relative rotation between the insert 26 and the body 24. Although the insert 26 is shown fitting snugly inside the body 24, the same size insert could be mounted in larger body sizes by means such as a sheath of cement formed between the outer surface of the insert and the inner walls of the body. Moreover, the valve element 36 could be in the form of a ball that seats upward against a spherical seat, such ball having an integral stem on its lower side that slides in a spider. A detent ring on the spider could be arranged to enter a groove on the stem to lock the valve open. Such structure is an equivalent and within the scope of this invention. Another alternative would be a normally closed flapper valve that seats upwardly against an insert. A tubular stringer on the insert which is adapted to receive a circulating drop ball could be used to force the flapper valve open and then hold it open to permit upward flow.

FIG. 2 shows the "running-in" condition of the cement shoe 15, that is, the relative position of parts as the casing string 14 is being run to bottom. Since the pressure of drilling mud standing in the well bore 10 acts via the ports 27 and 30 radially inward on the valve element 36, as well as upwardly thereon via the port 35, and since the valve element is biased upward by the spring 38, the valve element remains closed against the seat 37 where an additional seal ring 39 prevents leakage. The casing 13 can be progressively filled with fluids at the surface as the individual joints or stands thereof are connected end-to-end. Once the casing string 13 has been landed as shown in FIG. 1, conditioning fluid can be circulated down the bore 9 thereof and out into the annulus 18 at the bottom of the borehole 10 in order to clean up the well annulus in the usual manner. When the fluids in the casing 14 are pressurized to initiate flow, the valve element 36 in the sleeve 15 will shift downward to an open position as shown by phantom lines in FIG. 2. So long as the circulation flow rate does not exceed a certain maximum value, such as 10 barrels per minute, the valve element 36 will be returned by the spring 38 to the closed position when circulation is terminated. However when such rate is exceeded, the pressure and flow forces on the valve element 36 shift it down to a position where a split detent ring 45 on the insert 26 resiles inwardly into a groove 46 in the outer surface of the valve element 36 to lock the element in its open position. In this position fluids can flow in either direction through the radial and vertical ports 30 and 27 and the upper portion of the central flow passage 28.

Figure 4:
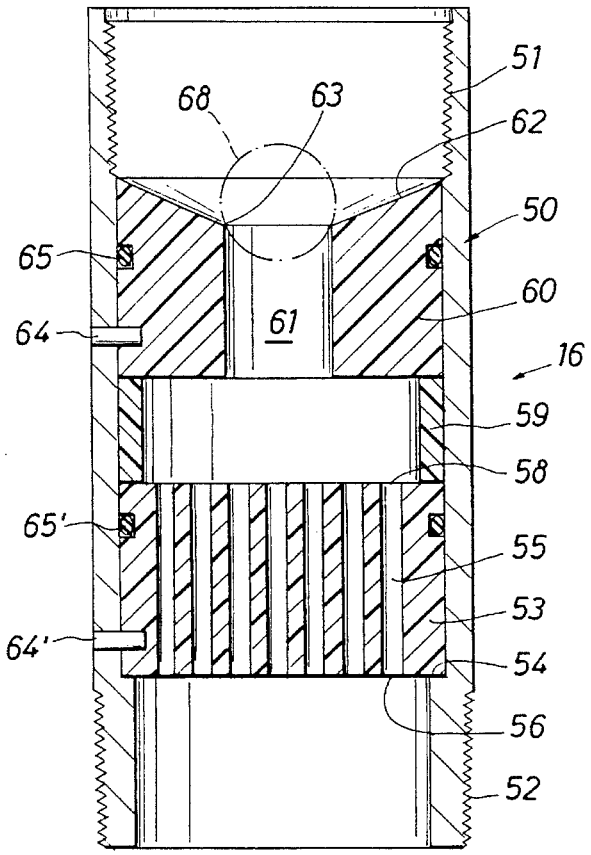
FIG. 4 is a cross-sectional view of the check valve assembly of FIG. 1.

FIG. 4 shows the check valve assembly 16 in longitudinal cross-section. The assembly 16 also includes a metal tubular body 50 having threads 51 and 52 at its respective upper and lower ends by which the body is connected between joints of the casing string 13. A lower plastic insert 53 seats against a body shoulder 54, and is provided with a large plurality of axial flow passages 55. Each of the passages 55 is conically tapered so that the diameter of its lower end 56 is somewhat larger than the diameter of its upper end 58. A spacer ring 59 is positioned between the upper end of the insert 53 and the lower end of an upper plastic insert member 60. The member 60 has a large flow port 61 in the center thereof, and the upper surface 62 of the member 60 is tapered downward and inward to provide a ball seat 63. Pins 64 and 64' are used to prevent relative rotation between the member 60 and the insert 53 and the body 50, and seal rings 65, 65' prevent fluid leakage. The total flow area through the assembly 16 is at least as large as the flow area through the cement shoe 15 to prevent any back pressure from being applied to the formations during pumping.

Figure 6:
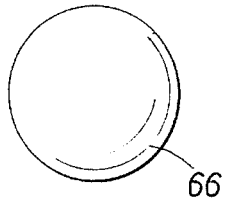
FIG. 6 is an enlarged view of a ball closure.
Figure 7:
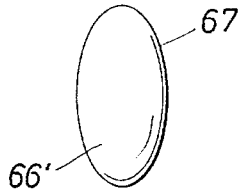
FIG. 7 is an enlarged top view of an alternate closure element that is pill-shaped.
Figure 5:
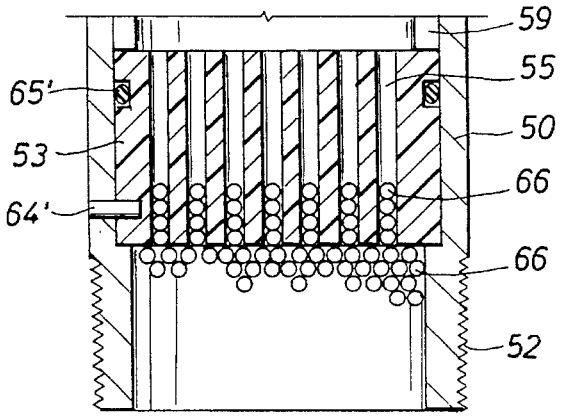
FIG. 5 is a fragmentary view of the check valve showing closure by suspended balls.

As shown in FIG. 5, the tapered flow passages 55 in the insert 53 are sized and arranged to be plugged by a plurality of balls 66 that are made of nylon or the like. Each ball 66 is sized such that it will enter the enlarged diameter lower end 56 of a passage, and move upward until it lodges at about the mid-point thereof as shown. Additional balls 66 may enter until the uppermost ball seats and blocks fluid flow. A large number of balls 66 is used as will be described below to ensure that all passages 55 in the insert 53 are closed. Each ball 66 can be spherical as shown in FIG. 6, or circular in its major section and elliptical in its minor section as shown in FIG. 7, which gives a pill-like construction. In other words the outline of a section through the dash-dot-dash line will be circular, whereas the outline as viewed from the top or bottom is elliptical. In a preferred form, the maximum thickness of the ball disc 66' is about one-half the diameter of its circular outline. For example when the circular diameter is ¾", the width of its middle portion is ⅜". The ball discs 66' are used primarily when the annular clearance between the casing strings 13 and 11 is such that a round or spherical ball 66 having a diameter of ¾" might not pass through such clearance. When the ball discs 66' are employed, however, they will readily pass through such clearance and eventually seat in the conical passages 55 in the insert 53. Even though the discs 66' land on edge, upward flow will cause them to rotate or pivot so that the circular sections thereof will be oriented at right angles to the axes of the passages 55. When this occurs the ball discs 66' will close the passages 55 against upward flow, in the same manner as the spherical balls 66.

In case the casing string 13 is to be internally tested for leaks, a metal ball 68 shown in phantom lines in FIG. 4 is dropped into the casing 14 so that it gravitates downward until it encounters the conical surface 62 of the insert member 60. The ball 68 has a larger diameter than the diameter of the flow passage or port 61, and thus rolls down and closes the port against downward flow. This enables pressure to be applied to the inner walls and the threaded connections of the casing string 14 to test the integrity thereof.

Figure 8:
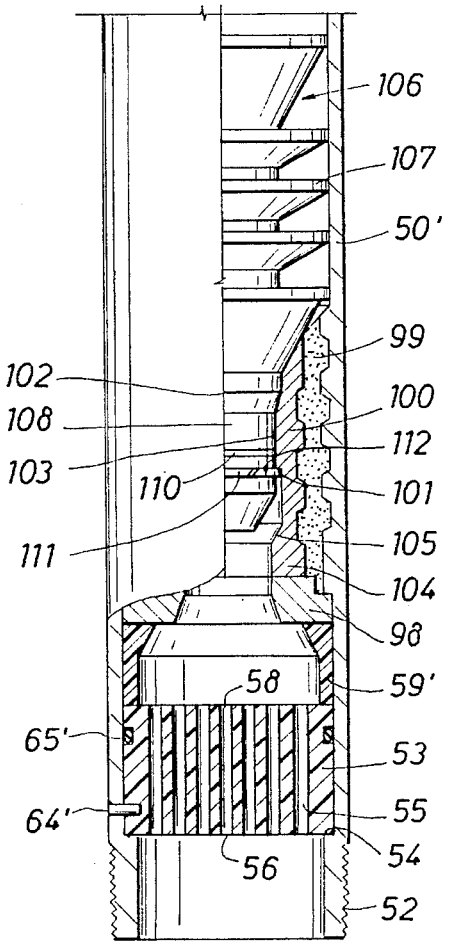
FIG. 8 is a longitudinal sectional view of a modified check valve that can be employed for conventional cementing.

In the event reverse circulating cementing is not for some reason continued in accordance with the present invention, conventional cementing can be carried out using the check valve assembly shown in FIG. 8. Here the housing or body 50' is extended further upward, and a seat sleeve 100 having a downwardly facing shoulder 101 is positioned within the housing by means such as a sheath of cement 49. A conical surface 102 of the sleeve 100 leads to a cylindrical throat 103, and an inwardly thickened shoulder 104 having an inclined upper surface 105 provides a stop. A cement plug assembly 106 having upwardly facing elastomer cups 107 includes a bottom nose 108 that carries a seal ring 110 and a split latch ring 111 in a groove below a shoulder 112. When the nose 108 is pumped down into the seat sleeve 100, the latch ring 111 is forced inward by the inclined surface 102 so that it enters the throat 103. Further downward movement positions the latch ring 111 below the shoulder 101, where the ring resiles outward and locks the nose 108 within the sleeve 100. The seal ring 110 engages the throat 103 to prevent fluid leakage.

The plug 106 follows a column of cement slurry that has been pumped into the casing string 14 at the surface. The cement goes through the passages 55 in the insert 53 and through the cement shoe 15 as previously described, and upward in the annulus 18 until the top of the column is several hundred feet up inside the intermediate string 11. When the plug 106 reaches the housing 50' it latches into the sleeve 100 to prevent back-flow of cement.

For cementing behind larger sizes of casing such as 16–24 inch, drill pipe can be run and screwed into threads (not shown) in the upper end of the latch sleeve 100. Cement then is pumped down through the drill pipe, followed by an appropriate size displacement plug 106. Hereagain the nose 108 of the plug latches and seals within the sleeve 100 and prevents backflow of cement that has been displaced into the annulus 18.

OPERATION

In operation and use of the present invention, the casing string 14 is installed as shown in FIG. 1 with the cementing shoe 15 located at the bottom end thereof and the check valve assembly 16 connected about two joints, for example, about the shoe 15. The valve plug 36 remains seated with respect to the seat 37 to prevent upward flow of mud into the casing 14. The casing 14 typically is filled as it is run with an appropriate liquid. As noted above, in case circulation is needed for any reason, the valve element 36 can be pumped open, and so long as a certain flow rate is not exceeded will reclose when circulation is stopped. After the casing 14 is landed, a swage nipple 70 is installed on the upper end thereof, and the smaller end of the nipple is connected to a flow line 71.

Conditioning fluids then can be circulated down the casing 14, out the shoe 15 and upward in the annulus 18 to clean up the annulus. After such cleaning, the circulation rate is increased momentarily to a selected value, for example 10 barrels per minute, which causes the valve plug 36 in the shoe 15 to be shifted downward far enough against the bias of the spring 38 that the resilient lock ring 45 enters the groove 46 to lock the valve plug 36 open. The shoe assembly 15 then is in the reverse cementing mode.

In order to fill the annulus 18 with cement, the blowout preventer 17 is closed against the casing 14, and the valve 21 in the annulus line 20 is opened. First a mud spacer 75 is mixed and pumped into the annulus 18 via the line 20 in order to physically separate the fluids standing in the annulus and the following cement slurry. A bail injector mechanism of the general type disclosed in U.S. Pat. No. 5,095,988, which is incorporated herein by reference, and having one of its chambers loaded with a selected number of the balls 66 or the ball discs 66', is connected to line 20. These elements then are injected either at the top of the spacer 75 or at the bottom or leading end of the cement slurry column 76. A calculated volume of slurry 76 then is pumped down the annulus 18 so that the spacer and slurry displace the fluids in the well annulus which flow up through the shoe 15, the check valve assembly 16, and the bore 9 of the casing 14 to the surface where the fluids pass out through the swage nipple 70 and the line 71. Since the cement slurry 76 may be more dense than the fluids being displaced, the flow area at the top of the swage nipple 70 has a lesser area than the respective flow areas through the check valve 16 and the shoe 15. This relationship keeps the fluids from returning upward through the casing 14 faster than the cement slurry 76 is being pumped down the annulus 18.

When the balls 66 or ball discs 66' reach the ports 55 in the check valve assembly 16, a ball or disc lodges in each of the ports to close the assembly 16 against upward flow. A pumping pressure increase registers at the surface, and flow ceases, to indicate that the cement is in place. The cementing operation then is complete. Pressure can be bled off from the inside of the casing 14 at the surface, and the test ball 68 dropped to enable pressure testing of the casing string for leaks. In most instances the casing 14 can be pressurized to about 75% of its internal yield strength without creating a micro-annulus between the casing and the cement. The volume of the displacement should be such that the upper end of the cement column 76 extends several hundred feet up inside the lower end of the intermediate casing string 11 in order to seal off the upper annulus space as well.

In the event it becomes desirable to drill out the check valve 16 and the shoe 15, this can be readily accomplished since the inserts 60, 59, 53 and 26 are made of a plastic material that is easily destroyed by a bit. The pins 64, 64' and 44 prevent rotation during drill-out.

It now will be recognized that a new and improved well cementing system has been disclosed which has numerous advantages over prior methods. To name but a few, less chemicals such as retardants are required because the pumping time is greatly reduced; stop collars and two stage cementing are eliminated, as well as use of casing annulus packers; top and bottom displacement plugs are unnecessary; casing can be landed with a top drive unit, and circulation of mud returns can be made through the top drive with no rigging-up at the surface; less cementing horsepower is required; and the substantial savings in rig time. Since certain changes or modifications may be made in the disclosed embodiments without departing from the inventive concepts involved, it is the aim of the appended claims to cover all such changes and modifications falling within the true spirit and scope of the present invention.

What is claimed is:

1. A method of cementing a string of casing in a well bore, said casing string having a cement shoe on the lower end thereof, comprising the steps of: providing an initially closed flow passage through said cement shoe so that when said passage is open fluids in the annulus between said casing string and the walls of said well bore can be displaced into said lower end of said casing string and flow upward toward the surface; providing a normally-open check valve means in said casing string above said cement shoe; opening said flow passage and pumping a column of cement slurry down said annulus to displace said fluids into said casing string while filling said annulus with said slurry; closing said check valve means when the lower end of said column of cement slurry begins to flow through said check valve means; and then allowing said slurry to harden in said annulus.

2. The method of claim 1 including the further steps of positioning check valve closing means in said annulus adjacent said lower end of said column of cement slurry; and pumping said closing means down said annulus ahead of said lower end whereby said closing means enters said flow passage and closes said check valve means before said cement slurry reaches said check valve means.

3. The method of claim 1 including the further steps of restricting the return flow of fluids out of the upper end of casing string as said cement slurry is being pumped into said annulus.

4. The method of claim 1 including the further step of sealing off the annulus adjacent the top of said well bore during said pumping step.

5. A system for use in cementing a string of casing in a well bore, comprising: shoe means on the lower end of said casing string providing a flow passage and valve means normally closing said flow passage against upward fluid flow; means responsive to downward flow of liquids through said casing string for opening said valve means and locking said valve means in said open position; normally open check valve means in said casing and positioned a selected distance above said shoe means; and closing means responsive to upward flow of fluid through said flow passage and said normally open check valve means for closing said check valve means.

6. The system of claim 5 where said check valve means includes a plurality of axial flow passages, said closing means comprising a plurality of closure elements arranged to seat in said flow passages and prevent upward flow therethrough.

7. The system of claim 6 where said closure elements are balls each being sized to become lodged in a flow passage and thereby prevent upward flow therethrough.

8. The system of claim 6 wherein said closure elements are ball disks that are circular in one cross-section and elliptical in another cross-section taken at a right angle to said one cross-section.

9. The system of claim 6 wherein each of said flow passages is conically tapered from a smaller diameter upper end to a greater diameter lower end.

10. Cement shoe means for use on the lower end of a casing string, comprising: a generally tubular body structure having formed therein a central bore, a plurality of laterally offset axial bores, and radial ports communicating the upper ends of said axial bores with said central bore and the exterior of said body; a valve member slidably arranged in said central bore and movable between an upper position for preventing flow through said axial and radial bores and a lower position permitting such flow; means biasing said valve member toward said upper position; flow responsive means for shifting said valve member to said lower position; and automatic means for locking said valve member in said lower position.

11. The cement shoe of claim 10 further including a valve seat surface surrounding said central bore above said radial ports, said valve member having an upper edge surface engaging said seat surface in said upper closed position.

* * * * *